US010266302B1

(12) United States Patent
Duarte

(10) Patent No.: US 10,266,302 B1
(45) Date of Patent: Apr. 23, 2019

(54) TIERED PIZZA BOX

(71) Applicant: Gabriel Duarte, Orange, CA (US)

(72) Inventor: Gabriel Duarte, Orange, CA (US)

( * ) Notice: Subject to any disclaimer, the term of this patent is extended or adjusted under 35 U.S.C. 154(b) by 0 days.

(21) Appl. No.: 16/168,712

(22) Filed: Oct. 23, 2018

(51) Int. Cl.
*B65D 5/48* (2006.01)
*B65D 5/49* (2006.01)
*B65D 5/50* (2006.01)

(52) U.S. Cl.
CPC ..... *B65D 5/48024* (2013.01); *B65D 5/5021* (2013.01); *B65D 5/5033* (2013.01); *B65D 5/5038* (2013.01); *B65D 2585/366* (2013.01)

(58) Field of Classification Search
CPC ..... Y10S 229/906; Y10S 229/915; Y10S 229/918; Y10S 229/939; B65D 5/48; B65D 2585/366; B65D 5/48022; B65D 5/6664
USPC .... 229/120.02, 120.03, 120.06, 120.32, 906, 229/916, 917, 918
See application file for complete search history.

(56) References Cited

U.S. PATENT DOCUMENTS 4,236,664 A * 12/1980 Hartelmuller ..... B65D 5/006 229/117.16
4,944,452 A * 7/1990 Kent ..... B65D 5/48018 229/120.21
4,957,237 A * 9/1990 Madonna ..... B65D 5/48018 229/120
4,971,242 A * 11/1990 LaNicca ..... B65D 5/427 229/120.21
4,979,667 A * 12/1990 Seaman ..... B65D 5/2033 229/109
5,002,221 A * 3/1991 Ragan ..... B65D 5/48024 229/120
5,351,880 A * 10/1994 Goudreau ..... B65D 5/50 229/109
5,560,539 A * 10/1996 Baxter ..... B65D 5/0227 229/109
5,702,054 A * 12/1997 Philips ..... B65D 5/6664 229/110
5,772,110 A * 6/1998 Garretson ..... B65D 5/009 206/749
5,881,948 A * 3/1999 Correll ..... B65D 5/2033 229/101
5,950,912 A * 9/1999 Economopoulos .. B65D 5/5021 229/120.32
6,386,440 B1 * 5/2002 Tulkoff ..... B65D 5/48024 229/120.06
6,851,601 B1 * 2/2005 Montoya ..... B65D 5/5038 229/120

(Continued)

*Primary Examiner* — Brian D Nash
(74) *Attorney, Agent, or Firm* — Cionca IP Law P.C.; Marin Cionca

(57) ABSTRACT

A tiered pizza box for separately housing a first food item and a second food item, having: a lower box portion having a floor; a left wall; a right wall; a front wall; and a rear wall; an upper lid portion having a lid top; a left flap; a right flap; and a front flap; corner tabs; a plurality of corner slot sets; the tiered pizza box being configured to be folded into an assembled state, forming a lower interior space; and corner brackets configured to be inserted into the plurality of corner slot sets to form a support structure; a tier insert configured to rest on the support structure, forming an upper interior space; such that the first food item can be housed within the lower interior space, and the second food item can be housed within the upper interior space.

20 Claims, 6 Drawing Sheets

(56) References Cited

U.S. PATENT DOCUMENTS

| | | | | |
|---|---|---|---|---|
| 6,915,949 | B1 * | 7/2005 | Economopoulos | B65D 5/4295 229/120.32 |
| 8,365,981 | B1 * | 2/2013 | Perlsweig | B65D 5/48024 229/120.18 |
| 8,800,850 | B2 * | 8/2014 | MacLeod | B65D 5/2033 229/109 |
| 8,857,701 | B2 * | 10/2014 | Mandreucci | B23P 17/00 206/45.21 |
| D738,157 | S * | 9/2015 | Krumm | D7/354 |
| 2003/0062406 | A1 * | 4/2003 | Lizzio | B65D 5/0015 229/120 |
| 2004/0084514 | A1 * | 5/2004 | Casanovas | B65D 5/0045 229/117.07 |
| 2013/0119066 | A1 * | 5/2013 | Hanna | B65D 5/6661 220/532 |
| 2015/0068945 | A1 * | 3/2015 | Baker | B65D 5/0055 206/509 |

* cited by examiner

TIERED PIZZA BOX

BACKGROUND OF INVENTION

1. Field of the Invention

The invention relates generally to food storage and more specifically to boxes for pizza storage and delivery.

2. Description of the Related Art

Current known systems for storage and delivery of pizza often use cardboard single-use boxes, each for containing a single pizza. However, this can be wasteful of resources when a user purchases or orders more than one pizza at a time. As is currently known in the art, when a user purchases or orders multiple pizzas in a single order or delivery, each pizza is typically delivered or carried in its own individual box, with no efficient way to combine more than one pizza into a box. Pizzas may become damaged by inclusion of multiple pizzas into pizza boxes that are currently known in the art, such as, for example, of multiple pizzas are simply stacked on top of one another in a single box. There is an inability to include multiple pizzas or other similar foods into a single, space-saving box without causing damage to one or more of the pizzas. Thus, space and resources for the construction of the boxes are wasted.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a tiered pizza box is provided, having a lower box portion providing a space for a food item such as a pizza; a tier insert having a floor for a second food item, and brackets in the corners of the box supporting the platform insert such that the first food item is protected without the platform insert resting on top of the food item. The tier insert is provided with a left tier wall and a right tier wall, and the lower box portion is provided with a notch on the left wall and on the right wall, such that the left tier wall and the right tier wall are accessible to a user when the tier insert is to be removed from the box to provide access to the space in the lower box portion. Thus, an advantage is that a single tiered pizza box may be used for storage and delivery of two pizzas, without the need for stacking the pizzas directly on top of one another, and thus preventing damage to the pizzas while saving space. Another advantage is that materials and cost for the production of pizza boxes may be reduced due to requiring less materials to construct the tiered pizza box than is needed to construct two whole pizza boxes. Another advantage is that the capability of the tiered pizza box to be in a flat, unfolded state may save space for the user. Another advantage is that the tiered pizza box may be easy and efficient for a user to fold into an assembled state.

In another aspect, a tiered pizza box configured to separately house a first food item and a second food item is provided, the tiered pizza box comprising: a main box body having: a lower box portion having a lower box portion floor; a left wall extending outwards from the lower box portion floor, and having a left wall notch; a right wall extending outwards from the lower box portion floor, and having a right wall notch; a front wall extending outwards from the lower box portion floor; and a rear wall extending outwards from the lower box portion floor; an upper lid portion having a lid top; a left side flap extending outwards from the lid top; a right side flap extending outwards from the lid top; and a front side flap extending outwards from the lid top; a front left corner tab extending outwards from the front wall; a front right corner tab extending outwards from the front wall; a rear left corner tab extending outwards from the rear wall; and a rear right corner tab extending outwards from the rear wall; a plurality of corner slot sets, comprising: a set of front left corner slots, having: a first front left corner slot provided within the front left corner tab, a second front left corner slot provided within the front wall, and a third front left corner slot provided within the left wall; a set of front right corner slots, having: a first front right corner slot provided in the front right corner tab, a second front right corner slot provided within the front wall, and a third front right corner slot provided in the right wall; a set of rear left corner slots, having: a first rear left corner slot provided within the rear left corner tab, a second rear left corner slot provided within the rear wall, and a third rear left corner slot provided within the left wall; a set of rear right corner slots, having: a first rear right corner slot provided within the rear right corner tab, a second rear right corner slot provided within the rear wall, and a third rear right corner slot provided within the right wall; wherein the front left corner tab is foldable such that the first front left corner slot and the third front left corner slot are aligned, the front right corner tab is foldable such that the first front right corner slot and the third front right corner slot are aligned, the rear left corner tab is foldable such that the first rear left corner slot and the third rear left corner slot are aligned, and the rear right corner tab is foldable such that the first rear right corner slot and the third rear right corner slot are aligned; creases provided between: the lower box portion floor and the left wall; the lower box portion floor and the right wall; the lower box portion floor and the front wall; the lower box portion floor and the rear wall; the lid top and the rear wall; the lid top and the left side flap; the lid top and the right side flap; the lid top and the front side flap; the front wall and the front left corner tab; the front wall and the front right corner tab; and the rear wall and the rear left corner tab; wherein the main box body is configured to be in a flat unfolded state and folded into an assembled state when folded along the creases, such that: the left wall, the right wall, the front wall, and the rear wall are perpendicular with respect to the lower box portion floor, such that a lower interior space is formed by the left wall, the right wall, the front wall, the rear wall, and the lower box portion floor; and the left side flap, the right side flap, and the front side are perpendicular with respect to the lid top; a plurality of corner brackets, each corner bracket of the corner brackets having a rectangular shape, and being configured to be inserted into a corner slot set of the plurality of corner slots sets when the main box body is in the assembled state to form a support structure; a tier insert configured to fit inside of the main box body by resting on the support structure, the platform insert having:

a tier floor; a left tier wall extending outwards from the tier floor; and a right tier wall extending outwards from the tier floor; such that an upper interior space is formed by the tier floor, the left tier wall, and the right tier wall when the tier insert is placed on the support structure; such that the first food item can be housed within the lower interior space, and the second food item can be housed within the upper interior space, without the second food item resting directly on top of the first food item. Again, an advantage is that a single tiered pizza box may be used for storage and delivery of two pizzas, without the need for stacking the pizzas directly on top of one another, and thus preventing damage to the pizzas while saving space. Another advantage is that materials and cost for the production of pizza boxes may be reduced due to requiring less materials to construct the tiered pizza box than is needed to construct two whole pizza boxes. Another advantage is that the capability of the tiered pizza box to be in a flat, unfolded state may save space for the user. Another advantage is that the tiered pizza box may be easy and efficient for a user to fold into an assembled state.

In another aspect, a tiered pizza box configured to separately house a first food item and a second food item is provided, the tiered pizza box comprising: a main box body having: a lower box portion having a lower box portion floor; a left wall, the left wall being foldable and extending outwards from the lower box portion floor; a right wall, the right wall being foldable and extending outwards from the lower box portion floor; a front wall, the front wall being foldable and extending outwards from the lower box portion floor; and a rear wall, the rear wall being foldable and extending outwards from the lower box portion floor; an upper lid portion having a lid top; a left side flap, the left side flap being foldable and extending outwards from the lid top; a right side flap, the right side flap being foldable and extending outwards from the lid top; and a front side flap, the front side flap being foldable and extending outwards from the lid top; a front left corner tab extending outwards from the front wall; a front right corner tab extending outwards from the front wall; a rear left corner tab extending outwards from the rear wall; and a rear right corner tab extending outwards from the rear wall; a plurality of corner slot sets, comprising: a set of front left corner slots, having: a first front left corner slot provided within the front left corner tab, a second front left corner slot provided within the front wall, and a third front left corner slot provided within the left wall; a set of front right corner slots, having: a first front right corner slot provided in the front right corner tab, a second front right corner slot provided within the front wall, and a third front right corner slot provided in the right wall; a set of rear left corner slots, having: a first rear left corner slot provided within the rear left corner tab, a second rear left corner slot provided within the rear wall, and a third rear left corner slot provided within the left wall; a set of rear right corner slots, having: a first rear right corner slot provided within the rear right corner tab, a second rear right corner slot provided within the rear wall, and a third rear right corner slot provided within the right wall; wherein the front left corner tab is foldable such that the first front left corner slot and the third front left corner slot are aligned, the front right corner tab is foldable such that the first front right corner slot and the third front right corner slot are aligned, the rear left corner tab is foldable such that the first rear left corner slot and the third rear left corner slot are aligned, and the rear right corner tab is foldable such that the first rear right corner slot and the third rear right corner slot are aligned; wherein the main box body is configured to be in a flat unfolded state and folded into an assembled state, such that: the left wall, the right wall, the front wall, and the rear wall are perpendicular with respect to the lower box portion floor, such that a lower interior space is formed by the left wall, the right wall, the front wall, the rear wall, and the lower box portion floor; and the left side flap, the right side flap, and the front side are perpendicular with respect to the lid top; a plurality of corner brackets, each corner bracket of the corner brackets having a rectangular shape, and being configured to be inserted into a corner slot set of the plurality of corner slots sets when the main box body is in the assembled state to form a support structure; a tier insert configured to fit inside of the main box body by resting on the support structure, the platform insert having: a tier floor; such that an upper interior space is formed within the main box body by the tier floor when the tier insert is placed on the support structure; such that the first food item can be housed within the lower interior space, and the second food item can be housed within the upper interior space, without the second food item resting directly on top of the first food item. Again, an advantage is that a single tiered pizza box may be used for storage and delivery of two pizzas, without the need for stacking the pizzas directly on top of one another, and thus preventing damage to the pizzas while saving space. Another advantage is that materials and cost for the production of pizza boxes may be reduced due to requiring less materials to construct the tiered pizza box than is needed to construct two whole pizza boxes. Another advantage is that the capability of the tiered pizza box to be in a flat, unfolded state may save space for the user. Another advantage is that the tiered pizza box may be easy and efficient for a user to fold into an assembled state.

In another aspect, a method of assembling and using a tiered pizza box to separately house a first food item and a second food item is provided, the tiered pizza box the tiered pizza box comprising: a main box body having: a lower box portion having a lower box portion floor; a left wall, the left wall being foldable and extending outwards from the lower box portion floor; a right wall, the right wall being foldable and extending outwards from the lower box portion floor; a front wall, the front wall being foldable and extending outwards from the lower box portion floor; and a rear wall, the rear wall being foldable and extending outwards from the lower box portion floor; an upper lid portion having a lid top; a left side flap, the left side flap being foldable and extending outwards from the lid top; a right side flap, the right side flap being foldable and extending outwards from the lid top; and a front side flap, the front side flap being foldable and extending outwards from the lid top; a front left corner tab extending outwards from the front wall; a front right corner tab extending outwards from the front wall; a rear left corner tab extending outwards from the rear wall; and a rear right corner tab extending outwards from the rear wall; a plurality of corner slot sets, comprising: a set of front left corner slots, having: a first front left corner slot provided within the front left corner tab, a second front left corner slot provided within the front wall, and a third front left corner slot provided within the left wall; a set of front right corner slots, having: a first front right corner slot provided in the front right corner tab, a second front right corner slot provided within the front wall, and a third front right corner slot provided in the right wall; a set of rear left corner slots, having: a first rear left corner slot provided within the rear left corner tab, a second rear left corner slot provided within the rear wall, and a third rear left corner slot provided within the left wall; a set of rear right corner slots, having: a first rear right corner slot provided within the rear right corner tab, a second rear right corner slot provided within the rear wall, and a third rear right corner slot provided within the right wall; wherein the front left corner tab is foldable such that the first front left corner slot and the third front left corner slot are aligned, the front right corner tab is foldable such that the first front right corner slot and the third front right corner slot are aligned, the rear left corner tab is foldable such that the first rear left corner slot and the third rear left corner slot are aligned, and the rear right corner tab is foldable such that the first rear right corner slot and the third rear right corner slot are aligned; wherein the main box body is configured to be in a flat unfolded state and folded into an assembled state, such that: the left wall, the right wall, the front wall, and the rear wall are perpendicular with respect to the lower box portion floor, such that a lower interior space is formed by the left wall, the right wall, the front wall, the rear wall, and the lower box portion floor; and the left side flap, the right side flap, and the front side are perpendicular with respect to the lid top; a plurality of corner brackets, each corner bracket of the corner brackets having a rectangular shape, and being configured to be inserted into a corner slot set of the plurality of corner slots sets when the main box body is in the assembled state to form a support structure; a tier insert configured to fit inside of the main box body by resting on the support structure, the platform insert having: a tier floor; such that an upper interior space is formed within the main box body by the tier floor when the tier insert is placed on the support structure; such that the first food item can be housed within the lower interior space, and the second food item can be housed within the upper interior space, without the second food item resting directly on top of the first food item; the method comprising the steps of: providing the tiered pizza box in the flat unfolded state; folding the left wall, the right wall, the front wall, and the rear wall, such that the left wall, the right wall, the front wall, and the rear wall are perpendicular with respect to the lower box portion floor; folding the left side flap, the right side flap, and the front side flap, such that the left side flap, the right side flap, and the front side flap are perpendicular with respect to the lid top; folding the front left corner tab against the left wall such that the first front left corner slot and the third front left corner slot are aligned; folding the front right corner tab against the right wall, such that the first front right corner slot and the third front right corner slot are aligned; folding the rear left corner tab against the left wall, such that the first rear left corner slot and the third rear left corner slot are aligned; folding the rear right corner tab against the right wall, such that the first rear right corner slot and the third rear right corner slot are aligned; inserting each corner bracket of the plurality of corner brackets into each corner slot set of the plurality of corner slot sets; placing the first food item into the lower interior space; resting the tier insert on top of the support structure; placing the second food item into the upper interior space; and closing the upper lid portion onto the lower box portion by sliding the left side flap against the left wall, sliding the right side flap against the right wall, and sliding the front side flap against the front wall. Again, an advantage is that a single tiered pizza box may be used for storage and delivery of two pizzas, without the need for stacking the pizzas directly on top of one another, and thus preventing damage to the pizzas while saving space. Another advantage is that materials and cost for the production of pizza boxes may be reduced due to requiring less materials to construct the tiered pizza box than is needed to construct two whole pizza boxes. Another advantage is that the capability of the tiered pizza box to be in a flat, unfolded state may save space for the user. Another advantage is that the tiered pizza box may be easy and efficient for a user to fold into an assembled state.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
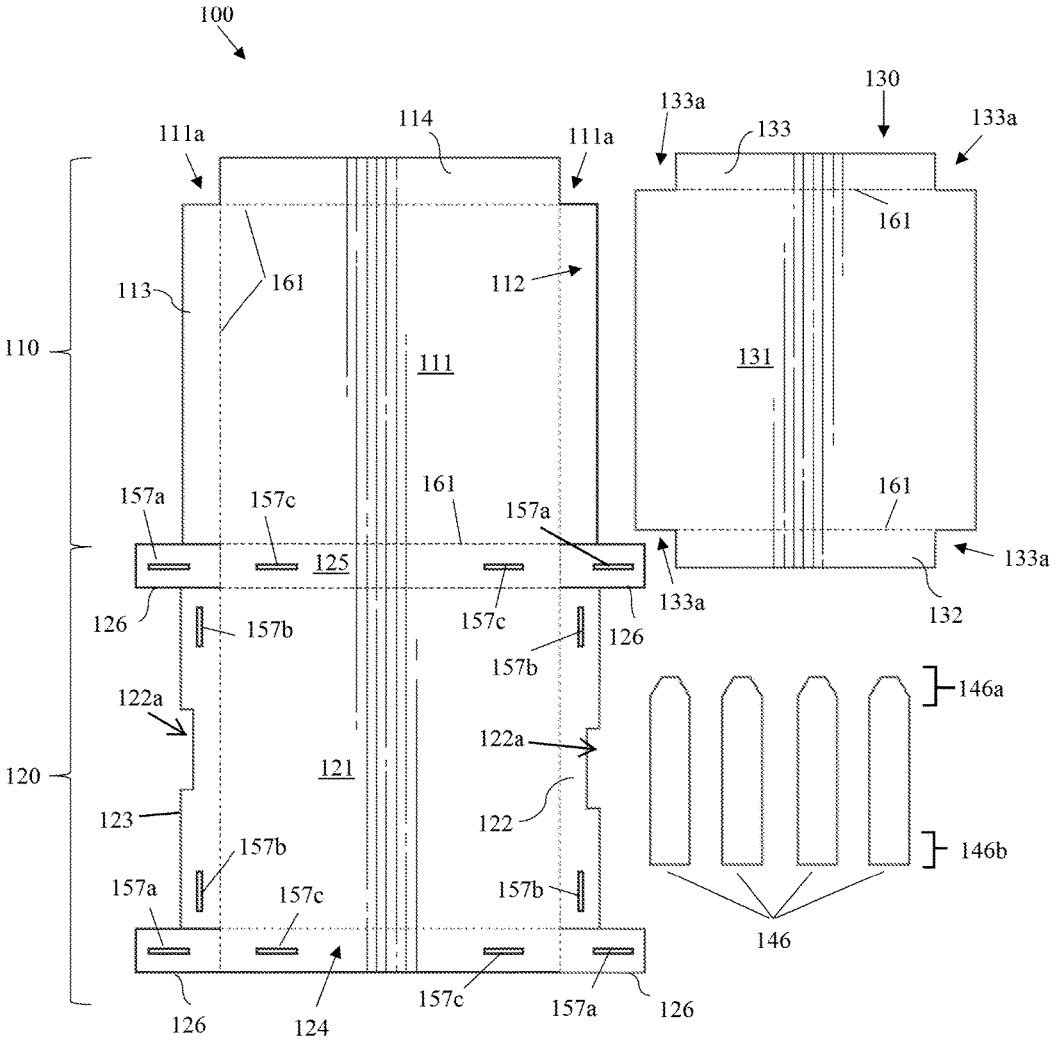
FIG. 1 illustrates a top plan view of elements or components that may comprise a tiered pizza delivery box, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 131 and 231, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates a top plan view of elements or components that may comprise a tiered pizza delivery box ("layered pizza box," "layered pizza delivery box," "tiered pizza box," "tiered box," "pizza box") 100, according to an aspect. The components of the tiered pizza box 100 are shown in FIG. 1 in a disassembled state as an example. A tiered pizza box 100 may be constructed from cardboard, or any other suitable materials, and may be provided in a flat, unassembled state, which may allow for slimmer and thus easier and more efficient packaging and shipping. A lower box portion ("bottom box portion," "lower box portion," "box portion," "bottom portion," "box") 120 may be provided, comprising a lower box portion floor ("lower portion floor," "box bottom," or "bottom") 121, a right wall 122, a left wall 123, a front wall 124, and a rear wall ("rear wall," or "back wall,") 125, and four corner tabs 126. The corner tabs 126 may extend horizontally outwards from the rear wall 125 or front wall 124. Each corner of the lower box portion 120 may be provided with a corner tab 126; thus, the tiered pizza box 100 may be provided with a front left corner tab, a front right corner tab, a rear left corner tab, and a rear right corner tab.

An upper lid portion ("upper lid portion," or "lid") 110 may be provided, comprising a lid top ("lid top," or "top") 111, a right side flap 112, a left side flap 113, and a front side flap 114. The right side flap 112, the left side flap 113, and the front side flap 114 may extend outwards from the lid top 111, such that right-angle lid notches 111*a* are formed. It should be noted that both the right and left wall 122 and 123 may have cutouts or side notches ("cutouts," "notches," or "notches") 122*a*, as disclosed in greater detail hereinafter. Thus, a tiered pizza box 100 may house a first pizza or other food item in the lower box portion, and house a second pizza or other food item on the tier, while separating the first and the second food items such that the pizzas or other food items are not directly stacked on top of one another.

Together, the lower box portion 120 and the upper lid portion 110, connected via the rear wall 125, may form a main box body, within which a platform insert ("platform insert," "separator," or "tier insert") 130 may be provided. The platform insert may comprise a platform floor ("platform floor," "tier floor," "platform," or "tier") 131, a right tier wall 132, and a left tier wall 133. The right tier wall 132 and the left tier wall 133 may each have a length shorter than the length of the tier insert 130, and both the right tier wall 132 and the left tier wall 133 may be centered on the length of the tier insert 130 such that right-angle tier notches 133*a* are formed on the corners of the tier insert 130. The tier insert 130 may be used to create a second space ("second space," or "upper space") within the tiered pizza box 100 in addition to the lower space created within the lower box portion, and the tier insert 130 may also function as a separator between the two pizzas carried in a single tiered pizza box 100. This may also help to protect both pizzas from damage, and also eliminates the need for stacking the pizzas directly onto one another when using a single box for two pizzas.

The tiered pizza box 100 may also be provided with four corner brackets 146. Each corner bracket 146 may be provided with an angled end or pointed end 146*a* and a flat end 146*b*, for example. Each of the four corners of the lower box portion 120 may be provided with a set of corner slots ("corner slots," or "slots") 157*a*, 157*b*, and 157*c*, wherein each of the corner brackets 146 are insertable into the slots, as will be described in further detail when referring to FIG. 2.

As an example, the set of corner slots 157*a*, 157*b*, and 157*c* may comprise three corner slots: a tab corner slot 157*a*, a vertical corner slot 157*b* (viewed as being vertical when the tiered pizza box is in an unfolded or unassembled state in a front or top view), and a horizontal corner slot 157*c*. Each corner tab 126 may be provided with a tab corner slot 157*a*, and each corner tab 126 may be provided on two sides with a vertical corner slot 157*b*, and a horizontal corner slot 157*c*. Thus, the tiered pizza box may be provided with the following set of corner slots as an example: a first front left corner slot provided within the front left corner tab; a second front left corner slot provided within the front wall; a third front left corner slot provided within the left wall; a first front right corner slot provided in the front right corner tab; a second front right corner slot provided within the front wall; a third front right corner slot provided in the right wall; a first rear left corner slot provided within the rear left corner tab; a second rear left corner slot provided within the rear wall; a third rear left corner slot provided within the left wall; a first rear right corner slot provided within the rear right corner tab; a second rear right corner slot provided within the rear wall; and a third rear right corner slot provided within the right wall.

The tiered pizza box 100 may be foldable, such as along the broken lines indicated by 161 as examples. The broken lines 161 may represent indents or creases that may serve as guides for folding, which may indicate to a user instructions for assembly. The tiered pizza box 100 may be assembled by folding the lid portion 110 and the box portion 120 along the lines and inserting the corner brackets 146 though the three slots at each corner of the box portion 120, such that a box is formed. Then, the platform portion 130 may be folded along the broken lines and inserted into the box formed by the lid portion 120 and the box portion 120, as disclosed hereinbelow. When a tiered pizza box 100 is in an assembled state, the tiered box 100 may hold a plurality of pizzas, wherein each pizza contained within the tiered box 100 is housed separated from the other pizzas, and each pizza does not touch and damage the other pizzas within the box 100. As an example, disclosed herein, a layered pizza box 100 may have two levels or tiers, and hold two pizzas. However, it should be noted that a tiered pizza box 100 with additional levels or tiers may be manufactured with corresponding or appropriate modifications to hold additional pizzas, such as by providing taller side walls 122 and 123, additional corner brackets, additional platform inserts, and so on.

As an example, the tiered pizza box 100 may be constructed from corrugated cardboard, or any other suitable material. An advantage may be that the corrugated cardboard may be easy to provide creases in, such as those indicated by 161, to serve as folding guidelines. It should be understood that the tiered pizza box 100 may be provided in a variety of sizes to fit a variety of pizzas, or any other suitable food item. Exemplary square dimensions that the tiered pizza box 100 may be provided in are as follows: 18 inches for each length and width for an extra-extra large (XXL) pizza, 16 inches for each length and width for an extra large (XL) pizza, 14 inches for each length and width for a large pizza, 12 inches for each length and width for a medium pizza, and 10 inches for each length and width for a small pizza. An exemplary length for each corner slot (as shown by 157*a*, 157*b*, and 157*c*) is 2 and ¼ inches. An exemplary length for each corner bracket 146 is approximately 6 and ½ inches. It should be understood that other exemplary sizes and dimensions may also be used to construct the tiered pizza box 100.

Figure 2:
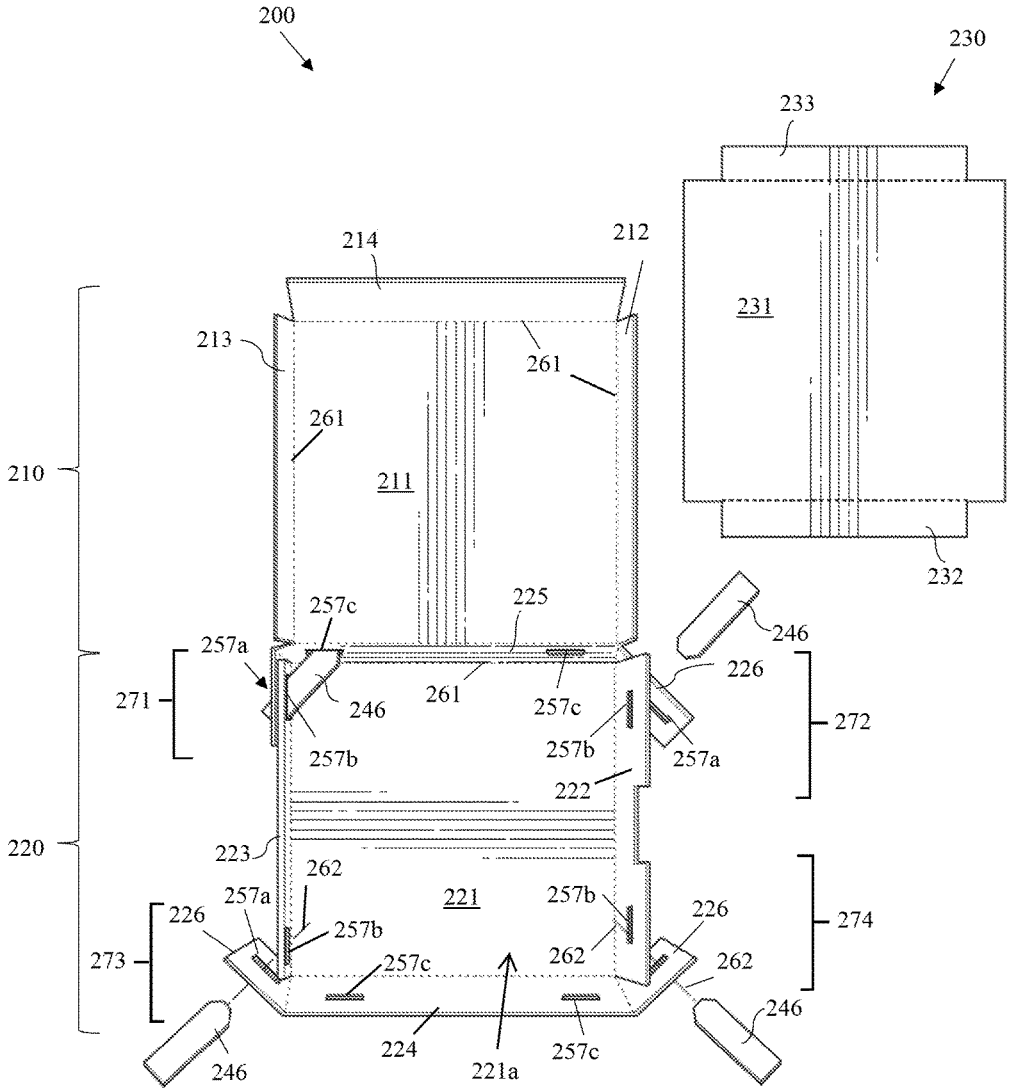
FIG. 2 illustrates a top view of the tiered pizza box in a partially assembled state, according to an aspect.

FIG. 2 illustrates a top view of the tiered pizza box 200 in a partially assembled state, according to an aspect. The rear left corner 271 of the lower box portion 220 is shown in an exemplary assembled state, and the remaining corners (rear right corner 272, front left corner 273, and front right corner 274) are shown in partially assembled states with the corner tabs 226 partially folded. As mentioned when referring to FIG. 1, a tiered pizza box 200 may be assembled by folding the upper lid portion 210 and the lower box portion 220 along the creases indicated by broken lines 261, inserting the corner brackets 246 into the corner slots 257*a-c*, then folding the platform insert 230 along the perforated lines and inserting it into the box formed by the lid portion 210 and the box portion 220. A more detailed description on this exemplary method of assembling a layered pizza box 200 follows.

Following assembly, the walls of lower box portion 220 of the tiered pizza box 200 may be formed by the right side wall 222, the left side wall 223, the front wall 224, and the rear wall 225. The formation of the walls may form a space 221*a* within the lower box portion 220, such that a pizza or any other similar food item may be placed onto the lower portion floor 221 and within the space 221*a*.

As shown, each corner tab 226 may be folded around the outside of the right side wall 222 or the left side wall 223, such that each tab corner slot 257*a* aligns with a corresponding vertical corner slot 257*b*. Next, a corner bracket 246 may be inserted through the aligned tab corner slot 257*a* and vertical corner slot 257*b*. The insertion of a corner bracket 246 may follow the exemplary lines of direction indicated by lines 262, as are shown as examples in the front left corner 273 and the front right corner 274. The angled end 246*a* of the corner brackets 246 may be inserted into the slots, and the angled end 246*a* may make the insertion process easier. Next, the angled end 246*a* of the corner brackets 246 may be inserted into the horizontal corner slot 257*c*. Again, a fully assembled corner of the lower box portion 220 is shown in the rear left corner 271. Each of the remaining corners 272, 273, and 274 may also be assembled in a similar manner. It should be understood that the angled end 146*a* of the corner bracket may be inserted into the aligned tab corner slot 257*a* together with the vertical slot 257*b* first, or the angled end 146*a* may be inserted into the horizontal slot 257*c* first. Thus, the corner brackets 246 may form a support structure for the tier insert 230.

It may be advantageous to fold the corner tabs 226 around the outside of the right wall 222 and left wall 223, as disclosed, which may make it easier to close the lid 210. However, it should be noted that the corner tabs 226 may also be folded into the inside of the right and left walls 222 and 223. It should also be noted that the corner brackets 246 may help to hold the lower box portion 220 of the tiered pizza box 200 together and they may also support the platform insert 230, as will be disclosed when referring to FIG. 3.

Once the bottom box portion 220 of the layered pizza box 200 is assembled, the right side flap 212, left side flap 213, and front side flap 214 of the lid portion 210 may also be folded along the creased or indented lines 261 to form the sides of the lid 210. Then, the right tier wall 232 and the left tier wall 233 of the platform insert 230 may be folded such that they extend upwards, and the platform insert 230 may be placed on top of the inserted corner brackets 246 of the assembled corners 271, 272, 273, and 274. Thus, the bottom box portion 220, the lid portion 210, and the platform insert 230 may form a layered pizza box 200. It should be noted that, in this example, two pizzas may be placed in the tiered pizza box 200 by placing the first pizza in the space 221*a* created in the lower box portion, and placing the second pizza on the platform 231.

Figure 3:
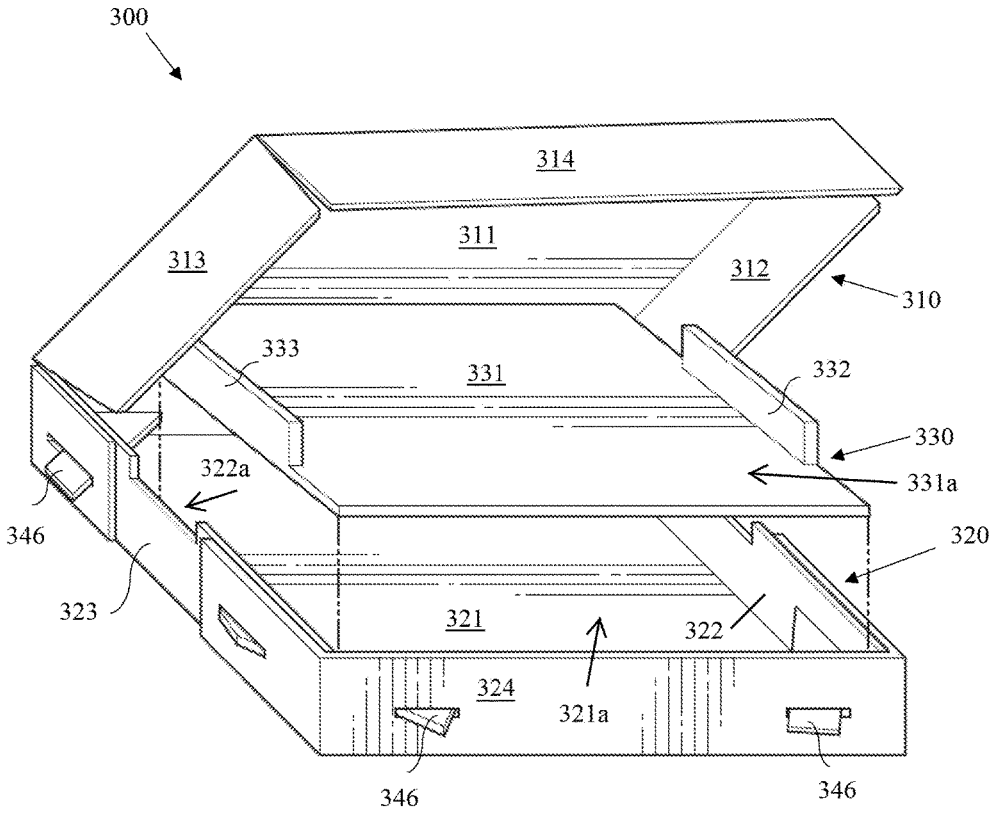
FIG. 3 illustrates an exploded perspective view of a tiered pizza box in an assembled state, according to an aspect.

FIG. 3 illustrates an exploded perspective view of a tiered pizza box 300 in an assembled state, according to an aspect. As an example, the assembly method disclosed when referring to FIG. 2 may have been used, wherein the top and bottom portions 310 and 320 were folded along the broken lines (161 of FIG. 1 and 261 of FIG. 2), the corner brackets 346 were inserted though the corner slots (257*a*, 257*b*, 257*c* of FIG. 2), and the platform insert 330 was folded along the broken lines (shown by 161 and 261 in FIGS. 1 and 2) and placed on top of the corner brackets 346. A lower interior space 321*a* may be formed within the lower box portion 320, wherein a pizza or other food item can be placed. When the platform insert 330 is placed into the box formed by the lower box portion 320, the right tier wall 332 and left tier walls 332 of the platform insert 330 may be oriented such that they are fitted snugly against the right side wall 322 and left side wall 333 of the lower box portion 320, respectively. An upper interior space 331*a* may be formed in which a pizza or other food item can be placed. When the tiered pizza box 300 is put into a folded state or an assembled state, the left wall 323, the right wall 322, the front wall 324, and the rear wall (partially visible in FIG. 3, and shown by 125 in FIG. 1) may be perpendicular with respect to the lower box portion floor 321, as shown. Similarly, the left side flap 313, the right side flap 312, and the front side flap 314 may be perpendicular with respect to the lid top 311. Each corner tab may be foldable such that the corner slots provided within each corner tab can be aligned with another corner slot provided within the left wall 323 or the right wall 322.

The box may be closed by closing the upper lid portion 310 onto the lower box portion 320. When the box 300 is in a closed state, the left side flap 313, the right side flap 312, and the front flap 314 may also rest on top of the corner brackets 346. It should be noted that the right side flap 312, left side flap 313, and front flap 314, may also be short enough to not be in contact with the corner brackets 346 while the lid is closed, for example. As an example, the left side flap 313 may slide next to the left tier wall 333, and the right side flap 312 may slide next to the right tier wall 332 when the box 300 is in a closed state. Thus, a tiered pizza box 300 can be formed or created into an assembled state by following the exemplary method and resting the tier floor 331 on top of the corner brackets 346.

It should be understood that the tier insert 330 may be configured to rest on the support structure formed by the corner brackets 346 without having tier walls. The tier insert 330 may also be provided with the left tier wall 333 and the right tier wall 332. An advantage may be that the tier insert 330 may be easier to lift out of the main box body when a user grasps the left tier wall 333 and the right tier wall 332.

It should also be understood that the left wall 323 may be provided with a left wall notch 322*a*, and the right wall 322 may be provided with a corresponding right wall notch (partially visible in FIG. 3, and shown by 122*a* in FIG. 1). An advantage may be that access to the left tier wall 333 and the right tier wall 332 may be provided such that a user may more easily grasp the platform insert 330 and remove it from the main box body.

Figure 4:
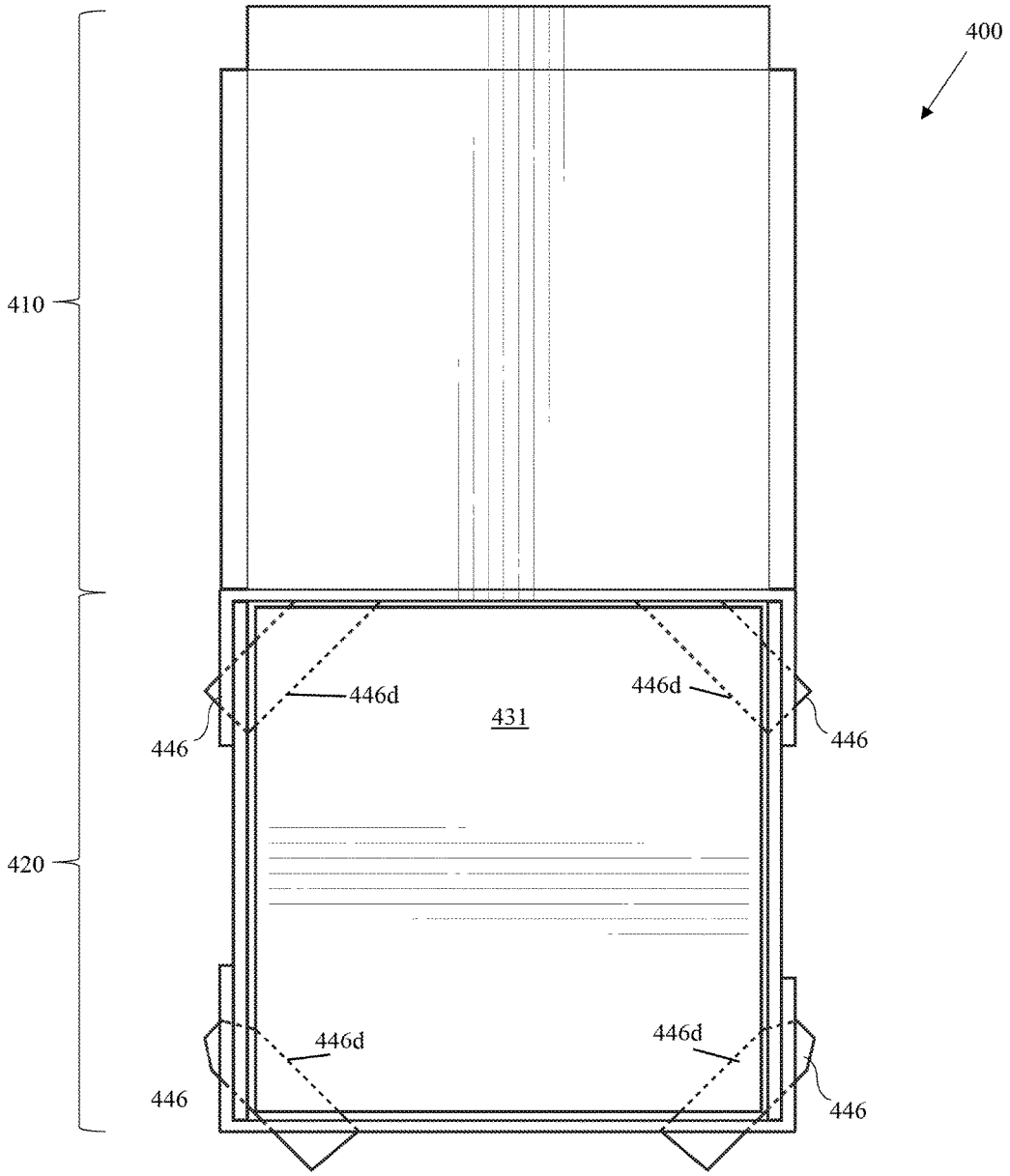
FIG. 4 illustrates a top view of a tiered pizza box in an open state, according to an aspect.

FIG. 4 illustrates a top view of a tiered pizza box 400 in an open state, according to an aspect. A tiered pizza box 400 is shown assembled with the lid portion 410 completely open and flat with respect to the lower box portion 420, i.e., the lid 410 is not closed onto the lower box portion 420. Additionally, the platform floor 431 is shown to be resting on the corner brackets 446, such that the corner brackets 446 as well as the lower portion floor (221 of FIG. 2) are beneath the platform 331. The portions of the corner brackets 446 that are underneath the platform 431 and therefore not visible are represented by the broken lines 446*d*. As shown an as example, the dimensions of the platform floor 431 may be slightly smaller than the space created by the formation of the walls of the lower box portion 420, such that the insertion of the platform 431 is not excessively tight, while remaining snugly inserted to ensure that the platform insert 430 is held in place. It may thus be easy and quick for the user to insert and remove the platform insert 430, such as, for example, to access food contained in the lower interior space.

An exemplary method of using a tiered pizza box 400 is as follows. After assembling a tiered pizza box 400 according to the exemplary method outlined above, but before inserting the platform insert, a user may place a pizza or similar food item on the lower portion floor (shown by 321 in FIG. 3). Once a pizza has been placed on the lower portion floor, a user may insert the platform insert 431. Then a user can place a second pizza or similar food item on the platform 431. Finally, a user can close the tiered pizza box 400 by closing the lid portion 410 onto the lower box portion 420. Thus, a tiered pizza box 400 may be used to transport a plurality of pizza or similar food items. As an example ("Example 1"), if a customer orders two pizzas, a first pizza may be placed on the lower portion floor and the second pizza may be placed on the platform 431. When said customer receives their order, they may open the tiered pizza box and remove the platform insert with or without the second pizza still on the platform floor 431 to provide easy access to the first pizza. Thus, only one box would be needed to deliver a customer's order.

Figure 5:
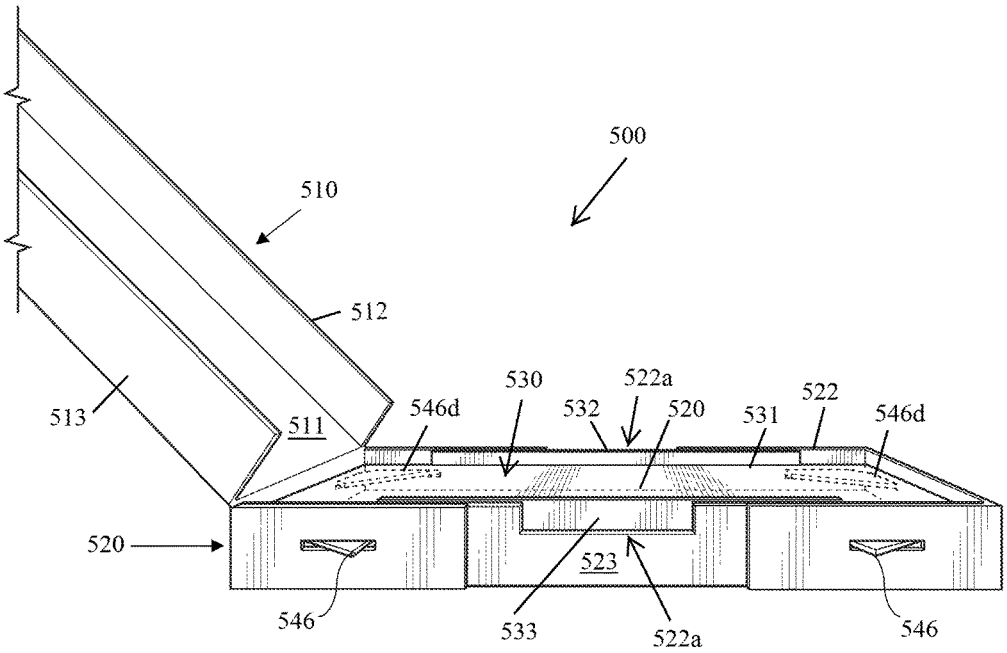
FIG. 5 illustrates a partial left side perspective view of a tiered pizza box in an open state, according to an aspect.

FIG. 5 illustrates a partial left side perspective view of a tiered pizza box 500 in an open state, according to an aspect. A tiered pizza box 500 is shown assembled with the lid portion 510 open and the platform floor 531 resting atop the corner brackets 546. At the right side of the tiered pizza box 500, the portions of the corner brackets underneath the platform insert 530 (and thus not visible) are shown by broken lines 546*d*. As shown in FIG. 5, the slots 557, and thus the corner brackets 546, may be located at the midpoint of the right side wall 522 and left side walls 523, for example. Additionally, the right and left tier walls 532 and 533 of the platform insert 531 may have a height such that, when the platform insert 531 is placed on the corner brackets 546, the edges of the right tier wall 532 and left tier walls 533 do not extend past the top edges of the right side wall 522 and left side walls 523 of the lower box portion 520. Thus, the platform insert 531, when used within the tiered pizza box 500, may be flush with the lower box portion 520 on the left and right sides of the box.

The right side wall 522 and the left side walls 523 of the lower box portion 520 may have notches 522*a*, as mentioned hereinbefore when referring to FIG. 1. These notches 522*a* may provide a user with convenient access to the right tier wall 532 and the left tier walls 533 of the platform insert. Thereby, a user may remove the platform insert 530 from the tiered pizza box 500 by grabbing the right tier wall 532 and the left tier walls 533 and lift the platform insert 530 out of the box 500.

For example, once the customer from Example 1 receives their order of two pizzas, they can access the first pizza resting on the lower portion floor in a plurality of ways. One method the customer may use is to remove the second pizza from the platform floor 531, then remove the now empty platform insert 530 by lifting it by holding the right tier wall 532 and left tier walls 533 to access the pizza. Another method the customer may use is to lift the platform insert 530 out of the pizza box 500 with the second pizza still on the platform floor 531 to access the first pizza resting on the lower portion floor.

As an example, when the lid 510 is closed onto the lower box portion 520, the left side flap 513 may fit snugly between left side wall 523 and the left tier wall 533. As another example, when the lid 510 is closed onto the lower box portion 520, the left side flap 513 may fit snugly against the inner side of the left tier wall 533, within the space created by the platform insert (as is shown by 331*a* in FIG. 3), such that the left tier wall 533 and the left side wall 523 are side-by-side. The lid 510 may be closed similarly on the right side of the tiered box. Similarly, the right side flap 512 may fit snugly between the right side wall 522 and the right tier wall 532. Again, similarly, the right side flap 512 may fit snugly against the inner side of the right tier wall 522, within the space created by the platform insert (again, as is shown by 331*a* in FIG. 3), such that the right tier wall 532 and the right side wall 522 are side-by-side.

Figure 6:
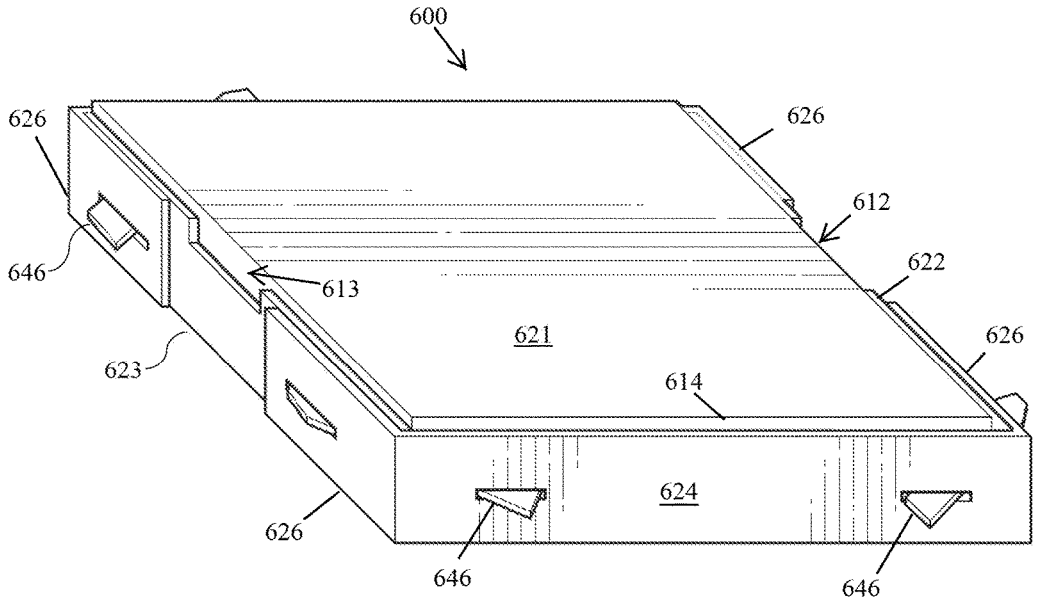
FIG. 6 illustrates a front perspective view of an assembled tiered pizza box in a closed state, according to an aspect.

FIG. 6 illustrates a front perspective view of an assembled tiered pizza box 600 in a closed state, according to an aspect. The tiered pizza box 600 shown by FIG. 6 may be closed using the method described when referring to FIG. 3, wherein the lid portion 610 is closed onto the lower box portion 620. Again, the left side flap 613 of the upper lid portion 610 may be side by side with inner side of the left tier wall (232 of FIG. 2) of the platform insert (230 of FIG. 2 and not shown in FIG. 6), and may have a snug fit; and the right side flap 612 may be side-by-side with the inner side of the right tier wall (233 of FIG. 2), and may have a snug fit. Again, the left side wall 222 and right side wall 223 of the lower box portion 620 may be side-by-side with the outer side of the left tier wall (232 of FIG. 2) and the right tier wall (233 of FIG. 2), respectively. Again as an example, the right side flap 612 may be sandwiched in between the right side wall 622 and the right tier wall 632, and the left side flap 623 may be sandwiched in between the left side wall 223 and the left tier wall 233. Similarly, the front flap, partially shown by 614 in the closed state, may fit snugly against the front wall 624.

As an example, the corner brackets 646 may remain unfolded as shown, or may be folded against the sides of the tiered pizza box 600 in order to save further space by putting the box 600 in a rectangular shape having no protrusions. Folding the corner brackets 646 against the sides of the tiered pizza box 600 may also allow a user to more easily slide or insert a tiered pizza box 600 into an insulating delivery bag, as known to those of ordinary skill in the art, or may make a plurality of tiered pizza boxes easier to store and stack. The folding of the corner brackets 646 may also save space It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A tiered pizza box configured to separately house a first food item and a second food item, the tiered pizza box comprising:

a main box body having:

a lower box portion having a lower box portion floor; a left wall extending outwards from the lower box portion floor, and having a left wall notch; a right wall extending outwards from the lower box portion floor, and having a right wall notch; a front wall extending outwards from the lower box portion floor; and a rear wall extending outwards from the lower box portion floor;

an upper lid portion having a lid top; a left side flap extending outwards from the lid top; a right side flap extending outwards from the lid top; and a front side flap extending outwards from the lid top;

a front left corner tab extending outwards from the front wall;

a front right corner tab extending outwards from the front wall;

a rear left corner tab extending outwards from the rear wall; and a rear right corner tab extending outwards from the rear wall;

a plurality of corner slot sets, comprising:

a set of front left corner slots, having: a first front left corner slot provided within the front left corner tab, a second front left corner slot provided within the front wall, and a third front left corner slot provided within the left wall;

a set of front right corner slots, having: a first front right corner slot provided in the front right corner tab, a second front right corner slot provided within the front wall, and a third front right corner slot provided in the right wall;

a set of rear left corner slots, having: a first rear left corner slot provided within the rear left corner tab, a second rear left corner slot provided within the rear wall, and a third rear left corner slot provided within the left wall;

a set of rear right corner slots, having: a first rear right corner slot provided within the rear right corner tab, a second rear right corner slot provided within the rear wall, and a third rear right corner slot provided within the right wall;

wherein the front left corner tab is foldable such that the first front left corner slot and the third front left corner slot are aligned, the front right corner tab is foldable such that the first front right corner slot and the third front right corner slot are aligned, the rear left corner tab is foldable such that the first rear left corner slot and the third rear left corner slot are aligned, and the rear right corner tab is foldable such that the first rear right corner slot and the third rear right corner slot are aligned;

creases provided between:

the lower box portion floor and the left wall;
the lower box portion floor and the right wall;
the lower box portion floor and the front wall;
the lower box portion floor and the rear wall;
the lid top and the rear wall;
the lid top and the left side flap;
the lid top and the right side flap;
the lid top and the front side flap;
the front wall and the front left corner tab;
the front wall and the front right corner tab; and
the rear wall and the rear left corner tab;

wherein the main box body is configured to be in a flat unfolded state and folded into an assembled state when folded along the creases, such that:

the left wall, the right wall, the front wall, and the rear wall are perpendicular with respect to the lower box portion floor, such that a lower interior space is formed by the left wall, the right wall, the front wall, the rear wall, and the lower box portion floor; and the left side flap, the right side flap, and the front side are perpendicular with respect to the lid top;

a plurality of corner brackets, each corner bracket of the corner brackets having a rectangular shape, and being configured to be inserted into a corner slot set of the plurality of corner slots sets when the main box body is in the assembled state to form a support structure;

a tier insert configured to fit inside of the main box body by resting on the support structure, the platform insert having:

a tier floor;

a left tier wall extending outwards from the tier floor; and a right tier wall extending outwards from the tier floor;

such that an upper interior space is formed by the tier floor, the left tier wall, and the right tier wall when the tier insert is placed on the support structure;

such that the first food item can be housed within the lower interior space, and the second food item can be housed within the upper interior space, without the second food item resting directly on top of the first food item.

2. The tiered pizza box of claim 1, wherein the tiered pizza box is constructed from cardboard.

3. The tiered pizza box of claim 1, the creases being further provided between:

the tier floor and the left tier wall; and the tier floor and the right tier wall.

4. The tiered pizza box of claim 1, wherein the tier floor has a first length; and wherein the left tier wall and the right tier wall each have a second length, the second length being shorter than the first length.

5. The tiered pizza box of claim 1, each corner bracket of the plurality of corner brackets further comprising a pointed end, and a flat end opposite to the pointed end.

6. A tiered pizza box configured to separately house a first food item and a second food item, the tiered pizza box comprising:

a main box body having:

a lower box portion having a lower box portion floor; a left wall, the left wall being foldable and extending outwards from the lower box portion floor; a right wall, the right wall being foldable and extending outwards from the lower box portion floor; a front wall, the front wall being foldable and extending outwards from the lower box portion floor; and a rear wall, the rear wall being foldable and extending outwards from the lower box portion floor;

an upper lid portion having a lid top; a left side flap, the left side flap being foldable and extending outwards from the lid top; a right side flap, the right side flap being foldable and extending outwards from the lid top; and a front side flap, the front side flap being foldable and extending outwards from the lid top;

a front left corner tab extending outwards from the front wall;

a front right corner tab extending outwards from the front wall;

a rear left corner tab extending outwards from the rear wall; and a rear right corner tab extending outwards from the rear wall;

a plurality of corner slot sets, comprising:

a set of front left corner slots, having: a first front left corner slot provided within the front left corner tab, a second front left corner slot provided within the front wall, and a third front left corner slot provided within the left wall;

a set of front right corner slots, having: a first front right corner slot provided in the front right corner tab, a second front right corner slot provided within the front wall, and a third front right corner slot provided in the right wall;

a set of rear left corner slots, having: a first rear left corner slot provided within the rear left corner tab, a second rear left corner slot provided within the rear wall, and a third rear left corner slot provided within the left wall;

a set of rear right corner slots, having: a first rear right corner slot provided within the rear right corner tab, a second rear right corner slot provided within the rear wall, and a third rear right corner slot provided within the right wall;

wherein the front left corner tab is foldable such that the first front left corner slot and the third front left corner slot are aligned, the front right corner tab is foldable such that the first front right corner slot and the third front right corner slot are aligned, the rear left corner tab is foldable such that the first rear left corner slot and the third rear left corner slot are aligned, and the rear right corner tab is foldable such that the first rear right corner slot and the third rear right corner slot are aligned;

wherein the main box body is configured to be in a flat unfolded state and folded into an assembled state, such that:

the left wall, the right wall, the front wall, and the rear wall are perpendicular with respect to the lower box portion floor, such that a lower interior space is formed by the left wall, the right wall, the front wall, the rear wall, and the lower box portion floor; and the left side flap, the right side flap, and the front side are perpendicular with respect to the lid top;

a plurality of corner brackets, each corner bracket of the corner brackets having a rectangular shape, and being configured to be inserted into a corner slot set of the plurality of corner slots sets when the main box body is in the assembled state to form a support structure;

a tier insert configured to fit inside of the main box body by resting on the support structure, the platform insert having:

a tier floor;

such that an upper interior space is formed within the main box body by the tier floor when the tier insert is placed on the support structure;

such that the first food item can be housed within the lower interior space, and the second food item can be housed within the upper interior space, without the second food item resting directly on top of the first food item.

7. The tiered pizza box of claim 6, the tier insert further comprising:

a left tier wall, the left tier wall being foldable and extending outwards from the tier floor; and a right tier wall, the right tier wall being foldable and extending outwards from the tier floor.

8. The tiered pizza box of claim 7, wherein the tier floor has a first length; and wherein the left tier wall and the right tier wall each have a second length, the second length being shorter than the first length.

9. The tiered pizza box of claim 6, wherein the tiered pizza box is constructed from cardboard.

10. The tiered pizza box of claim 6, the left wall further comprising a left wall notch, and the right wall further comprising a right wall notch.

11. The tiered pizza box of claim 6, each corner bracket of the plurality of corner brackets further comprising a pointed end, and a flat end opposite to the pointed end.

12. A method of assembling and using a tiered pizza box to separately house a first food item and a second food item, the tiered pizza box the tiered pizza box comprising:

a main box body having:

a lower box portion having a lower box portion floor; a left wall, the left wall being foldable and extending outwards from the lower box portion floor; a right wall, the right wall being foldable and extending outwards from the lower box portion floor; a front wall, the front wall being foldable and extending outwards from the lower box portion floor; and a rear wall, the rear wall being foldable and extending outwards from the lower box portion floor;

an upper lid portion having a lid top; a left side flap, the left side flap being foldable and extending outwards from the lid top; a right side flap, the right side flap being foldable and extending outwards from the lid top; and a front side flap, the front side flap being foldable and extending outwards from the lid top;

a front left corner tab extending outwards from the front wall;

a front right corner tab extending outwards from the front wall;

a rear left corner tab extending outwards from the rear wall; and a rear right corner tab extending outwards from the rear wall;

a plurality of corner slot sets, comprising:

a set of front left corner slots, having: a first front left corner slot provided within the front left corner tab, a second front left corner slot provided within the front wall, and a third front left corner slot provided within the left wall;

a set of front right corner slots, having: a first front right corner slot provided in the front right corner tab, a second front right corner slot provided within the front wall, and a third front right corner slot provided in the right wall;

a set of rear left corner slots, having: a first rear left corner slot provided within the rear left corner tab, a second rear left corner slot provided within the rear wall, and a third rear left corner slot provided within the left wall;

a set of rear right corner slots, having: a first rear right corner slot provided within the rear right corner tab, a second rear right corner slot provided within the rear wall, and a third rear right corner slot provided within the right wall;

wherein the front left corner tab is foldable such that the first front left corner slot and the third front left corner slot are aligned, the front right corner tab is foldable such that the first front right corner slot and the third front right corner slot are aligned, the rear left corner tab is foldable such that the first rear left corner slot and the third rear left corner slot are aligned, and the rear right corner tab is foldable such that the first rear right corner slot and the third rear right corner slot are aligned;

wherein the main box body is configured to be in a flat unfolded state and folded into an assembled state, such that:

the left wall, the right wall, the front wall, and the rear wall are perpendicular with respect to the lower box portion floor, such that a lower interior space is formed by the left wall, the right wall, the front wall, the rear wall, and the lower box portion floor; and the left side flap, the right side flap, and the front side are perpendicular with respect to the lid top;

a plurality of corner brackets, each corner bracket of the corner brackets having a rectangular shape, and being configured to be inserted into a corner slot set of the plurality of corner slots sets when the main box body is in the assembled state to form a support structure;

a tier insert configured to fit inside of the main box body by resting on the support structure, the platform insert having:

a tier floor;

such that an upper interior space is formed within the main box body by the tier floor when the tier insert is placed on the support structure;

such that the first food item can be housed within the lower interior space, and the second food item can be housed within the upper interior space, without the second food item resting directly on top of the first food item;

the method comprising the steps of:

providing the tiered pizza box in the flat unfolded state;

folding the left wall, the right wall, the front wall, and the rear wall, such that the left wall, the right wall, the front wall, and the rear wall are perpendicular with respect to the lower box portion floor;

folding the left side flap, the right side flap, and the front side flap, such that the left side flap, the right side flap, and the front side flap are perpendicular with respect to the lid top;

folding the front left corner tab against the left wall such that the first front left corner slot and the third front left corner slot are aligned;

folding the front right corner tab against the right wall, such that the first front right corner slot and the third front right corner slot are aligned;

folding the rear left corner tab against the left wall, such that the first rear left corner slot and the third rear left corner slot are aligned;

folding the rear right corner tab against the right wall, such that the first rear right corner slot and the third rear right corner slot are aligned;

inserting each corner bracket of the plurality of corner brackets into each corner slot set of the plurality of corner slot sets;

placing the first food item into the lower interior space;

resting the tier insert on top of the support structure;

placing the second food item into the upper interior space; and closing the upper lid portion onto the lower box portion by sliding the left side flap against the left wall, sliding the right side flap against the right wall, and sliding the front side flap against the front wall.

13. The method of claim 12, the tier insert further comprising:

a left tier wall, the left tier wall being foldable and extending outwards from the tier floor; and a right tier wall, the right tier wall being foldable and extending outwards from the tier floor.

14. The method of claim 13, further comprising the step of:

folding the left tier wall and the right tier wall, such that the left tier wall and the right tier wall are perpendicular with respect to the tier floor.

15. The method of claim 13, the left wall further comprising a left wall notch, and the right wall further comprising a right wall notch; and the method further comprising the steps of:

accessing the left tier wall via the left wall notch;

accessing the right tier wall via the right wall notch;

lifting the tier insert out of the main box body; and providing access to the first food item housed within the lower interior space.

16. The method of claim 15, wherein the step of inserting each corner bracket of the plurality of corner brackets is performed by inserting the pointed end into each corner slot set of the plurality of corner slot sets.

17. The method of claim 12, wherein the tier floor has a first length; and wherein the left tier wall and the right tier wall each have a second length, the second length being shorter than the first length.

18. The method of claim 12, each corner bracket of the plurality of corner brackets further comprising a pointed end, and a flat end opposite to the pointed end.

19. The method of claim 12, wherein the tiered pizza box is constructed from cardboard.

20. The method of claim 12, the tiered pizza box further comprising creases provided between:

the lower box portion floor and the left wall;

the lower box portion floor and the right wall;

the lower box portion floor and the front wall;

the lower box portion floor and the rear wall;

the lid top and the rear wall;

the lid top and the left side flap;

the lid top and the right side flap;

the lid top and the front side flap;

the front wall and the front left corner tab;

the front wall and the front right corner tab; and the rear wall and the rear left corner tab;

wherein the folding steps are performed by folding along the creases.

* * * * *